US005988401A

United States Patent [19]

Gardner et al.

[11] Patent Number: 5,988,401

[45] **Date of Patent: *Nov. 23, 1999**

[54] DISPLAY RACK WITH ALPHABETIC CHARACTERS CRADLING A BALL

[76] Inventors: Donald Dee Gardner; Patsy Joyce Gardner, both of 3801 Blevins Gap Rd., Louisville, Ky. 40272

[ * ] Notice: Under 35 U.S.C. 154(b), the term of this patent shall be extended for 4 days.

[21] Appl. No.: 08/866,014

[22] Filed: May 30, 1997

Related U.S. Application Data

[63] Continuation of application No. 08/676,682, Jul. 10, 1996, abandoned.

[51] Int. Cl.[6] ..... A47F 7/00

[52] U.S. Cl. ..... 211/14; D11/157; D6/450

[58] Field of Search ..... 211/14, 15; D6/552, D6/450; D11/157; D21/206, 208, 209, 715; 206/315.9; 473/420; 248/146, 176.1, 309.1, 316.8, 346.03

[56] References Cited

U.S. PATENT DOCUMENTS

| | | | |
|---|---|---|---|
| D. 169,787 | 6/1953 | Rasmussen | D6/450 |
| D. 210,837 | 4/1968 | Warner | D21/208 |
| D. 226,091 | 1/1973 | Brack . | |
| D. 258,125 | 2/1981 | Bailey | D11/157 |
| D. 261,789 | 11/1981 | Allen | D21/209 |
| D. 309,168 | 7/1990 | Smith | D21/209 |
| D. 309,226 | 7/1990 | Wilcox | D6/552 |
| D. 315,384 | 3/1991 | Lankford | D21/208 |
| D. 337,670 | 7/1993 | Carter | D6/450 X |
| D. 355,792 | 2/1995 | White | D6/450 |
| 1,024,536 | 4/1912 | Taylor | 206/315.9 X |
| 1,124,896 | 1/1915 | Hartman | D11/157 X |
| 1,678,944 | 7/1928 | Jacobsen | D21/208 X |
| 2,551,354 | 5/1951 | Wasilevich | 206/315.9 |
| 3,143,265 | 8/1964 | Ruderian | 211/14 X |
| 3,231,993 | 2/1966 | Levy | 211/14 X |
| 3,473,247 | 10/1969 | Favor et al. | 206/315.9 X |
| 3,516,667 | 6/1970 | Williams | 473/420 |
| 5,377,829 | 1/1995 | Bahl | 206/315.9 |
| 5,413,228 | 5/1995 | Le Clere | 211/14 X |

FOREIGN PATENT DOCUMENTS

| | | | |
|---|---|---|---|
| 914220 | 10/1946 | France | 211/14 |
| 270549 | 5/1927 | United Kingdom . | |
| 593938 | 10/1947 | United Kingdom | 211/14 |

*Primary Examiner*—Leslie A. Braun
*Assistant Examiner*—Stephen S. Wentsler
*Attorney, Agent, or Firm*—Laurence R. Brown

[57] ABSTRACT

A decorative ball display rack is formed of alphabetic characters, shaped and assembled in a self supporting array visibly displaying an abbreviated indicia identifying an institution sponsoring an athletic team, or the like, to present at least three upper receptacle tips formed by the letters and spaced to form a cradle for nestling and supporting a ball, typically a basketball, soccer ball or football.

3 Claims, 1 Drawing Sheet

DISPLAY RACK WITH ALPHABETIC CHARACTERS CRADLING A BALL

This application is a continuation of application Ser. No. 08/676682, filed Jul. 10, 1996, now abandoned.

TECHNICAL FIELD

This invention relates to ball and trophy mounts for supporting and visually displaying athletic balls such as footballs, basketballs, soccer balls, and the like, and more particularly it relates to novelty display racks for decoratively cradling and storing trophy balls in an artistic fashion that associates a displayed ball with a team or institution.

BACKGROUND ART

Display cases for holding and protecting trophy balls are known in the art, as exemplified in U. S. Pat. No. 5,377,829, granted Jan. 3, 1995 to R. J. Bahl for FOOTBALL DISPLAY CASE. Such cases are containers which visibly hold the balls in an environment foreign from the historical or sentimental background of a particular trophy ball on display.

It is accordingly an objective of this invention to provide novelty and improved trophy ball displays wherein the balls are accompanied by specific visible decorative background display configurations related to the historical and sentimental history of a displayed ball by identification of a team or institution.

DISCLOSURE OF THE INVENTION

This invention provides a decorative ball rack comprising a ball cradle formed from two or more alphabetic characters, typically an abbreviation or symbol of an athletic team of sponsoring institution, typically IU for Iowa University, UL for the University of Louisiana, ND for Notre Dame, KU for Kansas University or NY for the New York Giants.

Thus, the alphabetic characters are vertically stood upon a base member in a decorative array to be viewed together with a cradled ball as a memento or souvenir from a game, school or team. The upper tips of the alphabetic characters are preferably shaped with a planar surface to match the outer surface of a ball to be cradled, such as a football or basketball in typically a three or four point cradle that will securely balance and retain the ball in place by the force of gravity. Thus the displayed ball may be removed for inspection, dusting or replacement with a better souvenir such a game ball given a player.

Thus a combination of at least two alphabetic characters of decorative style is arranged in an artistic visual array presenting upper portions of said characters forming at least three uppermost branch receptacle members contoured to substantially conform to the outer surface of an athletic ball and spaced in positions constituting a cradle assembly for receiving and supporting the ball with the entire assembly of letters and ball coordinated into a decorative visual trophy. The alphabetic characters thereby comprise an ornamental display rack for holding a ball cradled therein to visibly display both an ornamental alphabetic character configuration and a ball supported thereon.

Other objectives, features, advantages and configurations shall be found throughout the following description, claims and accompanying drawings.

THE PREFERRED EMBODIMENTS

Figure 1:
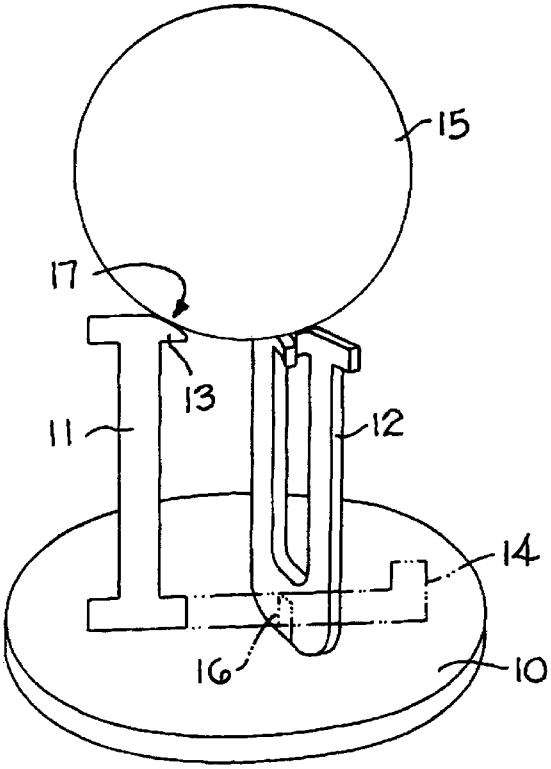
FIG. 1 is a perspective view sketch of a basketball supported in a display rack configuration having a ball receiving cradle formed of two alphabetic characters, as provided by the invention, with an alternative configuration suggested by the phantom lines.

In FIG. 1 a stable base or pedestal 10 has attached to it by molding, screwing or the like a set of upstanding alphabetic characters 11, 12 arranged in a decorative pattern, with their upper tips forming a cradle for nesting the basketball 15. The alphabetic characters and pedestal may be of molded plastic, carved wood, or the like, and may be styled in various decorative type styles.

The alphabetic characters I and U, for example may be the abbreviation for Indiana University or the University of Iowa. In an alternative configuration the characters, as shown by the phantom extension 14 and notched U base at 16, could be L U, the abbreviation for the University of Louisiana. In this case the notch 16 permits the base of the characters to be crisscrossed in a decorative configuration. In this configuration the alphabetic characters comprise planar panels formed in the shape of the respective characters, and the panels are disposed in planes that intersect at a suitable angle.

It is to be recognized that the alphabetic characters are artistically arranged in a decorative configuration, preferably colored with team or school colors. Also it is to be recognized that more than two alphabetic characters may be used such as IAI for Indiana Athletic Institute. The critical criterion is that the letters have at least three upper tips and that these tips be spaced in typically a three or four point array for stably supporting the desired ball, be it a soccer ball, a basketball, a football, or the like, full sized or miniature. Thus as seen in FIG. 1, the upper stems of the I and U are formed with a downwardly slanting tips 13 having a surface shaped to conform with the mating outer surface portion 17 of the ball 15. In the case of a basketball the downwardly slanted tip configuration 13 preferably has a contour substantially shaped as a segment of a sphere.

Figure 2:
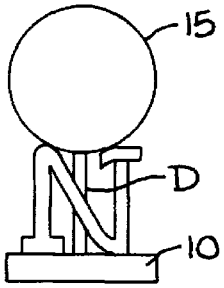
FIG. 2 is a side view sketch of a further configuration with a different set of alphabetic characters forming a cradle for receiving a basketball.

As seen from the side view configuration of FIG. 2 the letters N D, abbreviation for Notre Dame are similarly configured with a three point cradle for receiving a basketball, where the upper N joint and the vertical stem of the D preferably are slightly distorted to form a better three point cradle configuration.

Figure 3:
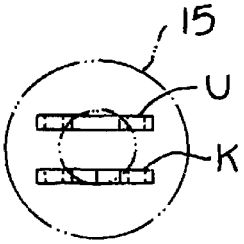
FIG. 3 is top view sketch of a still further configuration of characters wherein the phantom lines represent a basketball cradled in a configuration of the upper tips of he characters.

The FIG. 3 configuration from its top view shows a corresponding four point basketball cradle formed by the upper tips of the U and K that could identify the University of Kansas, for example. The phantom circle about the letter tips identifies the segment of basketball 15 that is nested in the four point cradle.

Figure 4:
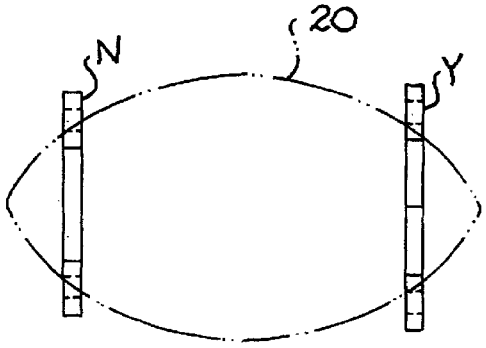
FIG. 4 is a top view sketch of a configuration of a display rack for holding a football, which is shown in phantom.

Similarly the four point cradle of FIG. 4, as seen from the top view, has the four points of the letters N and Y (typically for the New York Giants, forming a cradle for supporting the football 20.

Having therefore advanced the state of the art, those features of novelty representative of the spirit and nature of the invention are set forth with particularity in the following claims.

We claim:

1. An athletic souvenir display rack identifying a particular institution retaining and visibly displaying both an athletic ball with an outer surface of a particular shape and alphabetic acronym initials identifying the institution, comprising in combination:

a support base, a ball supporting mount configuration for said athletic ball extending upwardly from different positions on the support base and being formed of a visually prominent array of planar panels in the shape of at least two alphabetic characters arranged as said alphabetic initials, said characters presenting at least three upper tip portions wherein at least one alphabetic character presents two separated upper tip portions, a ball retaining structure formed by the upper tip portions of said alphabetic initials wherein the at least three tip portions are of contoured shape to substantially conform to and mate upon the outer surface of the athletic ball in spaced positions constituting a cradle assembly for stably receiving and supporting the ball by nesting in said cradle assembly.

2. An athletic souvenir display rack retaining and visibly displaying both an athletic ball having a shaped outer surface and alphabetic acronym initials identifying a particular institution having an athletic team, comprising in combination:

a support base, a ball supporting mount configuration extending upwardly from the support base formed of a combination of at least two said alphabetic characters to form an institution acronym from planar panels arranged in an array visibly presenting said alphabetic characters, said panels comprising at least three uppermost branch receptacle alphabetic character tips contoured to substantially conform to and mate upon the shaped outer surface of the athletic ball in spaced positions constituting a cradle assembly for stably receiving and supporting the ball with said acronym initials being visibly prominent, said alphabetic characters thereby comprising a display rack holding said athletic ball cradled therein to visibly display both said alphabetic acronym initials and the athletic ball supported thereon.

3. The rack of claim 2 wherein the shape of said uppermost tips comprise downwardly slanting tips formed by the upper extremity of the alphabetic characters into three surfaces substantially conforming to a segment of the outer surface of a round ball.

* * * * *